US007779918B2

(12) United States Patent
Cowie et al.

(10) Patent No.: US 7,779,918 B2
(45) Date of Patent: Aug. 24, 2010

(54) WELLBORE CONTROL DEVICE

(75) Inventors: Gavin David Cowie, Kincardineshire (GB); John David Sangster, Aberdeenshire (GB)

(73) Assignee: Enovate Systems Limited, Aberdeen (GB)

( * ) Notice: Subject to any disclaimer, the term of this patent is extended or adjusted under 35 U.S.C. 154(b) by 292 days.

(21) Appl. No.: 11/579,624

(22) PCT Filed: May 6, 2005

(86) PCT No.: PCT/GB2005/001719

§ 371 (c)(1),
(2), (4) Date: Mar. 13, 2008

(87) PCT Pub. No.: WO2005/108739

PCT Pub. Date: Nov. 17, 2005

(65) Prior Publication Data

US 2008/0257557 A1 Oct. 23, 2008

(30) Foreign Application Priority Data

May 7, 2004 (GB) ..... 0410198.6

(51) Int. Cl.
*E21B 34/06* (2006.01)

(52) U.S. Cl. ..... 166/373; 166/85.4

(58) Field of Classification Search ..... 166/85.4, 166/86.3, 361; 251/1.3; 464/163; 137/315.02, 137/315.29–32

See application file for complete search history.

(56) References Cited

U.S. PATENT DOCUMENTS

| | | | | |
|---|---|---|---|---|
| 1,839,394 | A * | 1/1932 | Inge | 251/1.1 |
| 3,500,708 | A * | 3/1970 | Wilson | 81/57.34 |
| 4,095,805 | A * | 6/1978 | Allen | 251/1.1 |
| 4,512,411 | A | 4/1985 | Pringle | |
| 4,715,456 | A * | 12/1987 | Poe et al. | 175/423 |
| 5,765,640 | A | 6/1998 | Milne et al. | |
| 5,979,550 | A | 11/1999 | Tessier | |
| 6,183,165 | B1 | 2/2001 | Heinrichs et al. | |
| 6,688,394 | B1 * | 2/2004 | Ayling | 166/380 |
| 7,389,817 | B2 * | 6/2008 | Almdahl et al. | 166/361 |
| 7,395,855 | B2 * | 7/2008 | Ayling | 166/77.52 |
| 2008/0142746 | A1 * | 6/2008 | Hemphill et al. | 251/1.3 |

* cited by examiner

*Primary Examiner*—Jennifer H Gay
*Assistant Examiner*—Kipp C Wallace
(74) *Attorney, Agent, or Firm*—Tarolli, Sundheim, Covell & Tummino LLP

(57) ABSTRACT

A wellbore control device (10) for sealing a wellbore is described. The device has, in a preferred arrangement, two opposed cutting rams (16, 18) which are coupled to respective linkage mechanisms (26, 28). The linkage mechanisms translate axial movement of a piston into radial movement to move the rams towards each other in the device throughbore. This results in an effective wellbore control device having a compact size and shape which can be encompassed within a wellbore.

9 Claims, 5 Drawing Sheets

WELLBORE CONTROL DEVICE

FIELD OF THE INVENTION

The present invention relates to an apparatus for sealing a throughbore, particularly but not exclusively for sealing a wellbore through which a workover string such as wireline or coiled tubing passes.

For the protection of personnel and the environment, oil installations are provided with a number of safety features, such as riser control devices, for sealing the wellbore.

BACKGROUND OF THE INVENTION

Riser control devices have cutting rams mounted perpendicular to a workover string. The rams can be activated to sever the workover string and seal the wellbore. The cutting rams move through a horizontal plane and are often driven by in-line pistons. The arrangement of the pistons and the cutting rams make the riser control device both cumbersome and ungainly. Their physical size makes them impractical for installing within an 18.5" bore.

Alternative methods of sealing the wellbore, such as ball valves are often used, however, these valves can be expensive to maintain and can be complicated to operate.

SUMMARY OF THE INVENTION

It is an object of the present invention to obviate or mitigate at least one of the aforementioned disadvantages.

According to a first aspect of the present invention there is provided a control device for sealing a wellbore, the device having a generally cylindrical housing, the housing having a cylindrical throughbore with a central axis for receiving a workover string, the housing including:

at least one moveable ram, at least one moveable piston, at least one linkage mechanism comprising a first linkage member and a second linkage member, the first linkage member having a first end and a second end, the first end being pivotally coupled to the at least one piston and the second end being pivotally coupled to the at least one ram, the second linkage member having a first end and a second end, the first end being pivotally coupled to the first linkage member and the second end being pivotally coupled to the housing, the linkage mechanism being arranged so that in response to movement of the at least one piston parallel to the axis of the throughbore towards the at least one ram, the linkage mechanism forces the at least one ram to move substantially orthogonally to the axis of the throughbore across the throughbore.

The linkage mechanism translates the axial motion of the at least one piston into radial motion of the at least one ram. This allows the device to have a compact size and shape and be encompassed within a wellbore.

Preferably, the pivotal coupling is achieved by using pin joints.

Pin joints are efficient pivotal mountings because frictional losses are minimised during movement of the mechanism making the mechanism intrinsically debris tolerant.

Preferably, the first end of the second linkage member is pivotally coupled to the midpoint of the first linkage member.

Preferably, the length of the first linkage member is twice the length of the second linkage member.

Preferably, the second end of the second linkage member is coupled to the housing by a pin joint, and the pin joint is located parallel to the axis of the throughbore with the pin joint at the first end of the first linkage member and located substantially orthogonally to the axis of the throughbore to the pin joint at the second end of the first linkage member.

This arrangement of the linkage mechanism progressively intensifies the force being delivered from the piston to the ram. A higher force towards the end of the travel of the ram is advantageous for cutting any obstruction, which may be present in the throughbore of the system.

Preferably, the at least one ram includes a cutting surface.

The cutting surface allows the ram to cut through the riser, which is more efficient than crushing.

Preferably, the cutting surface is designed to cut coiled tubing.

Preferably, there are two opposing rams and two linkage mechanisms.

Utilising two opposing rams and two linkage mechanisms allows shorter rams to seal the throughbore, reduces the overall size of the device and allows it to be used in confined spaces such as in a downhole environment.

Preferably, there is one annular piston.

According to a second aspect of the present invention there is provided a method of sealing a wellbore, the method comprising:

disposing a generally cylindrical housing in a well string, the housing having a throughbore with a central axis for receiving a workover string;

actuating at least one moveable piston in a direction parallel to the axis of the throughbore, coupling the piston by a linkage mechanism to at least one moveable ram, and causing the ram to move substantially orthogonally to the axis of the throughbore across the throughbore in response to the axial movement of the piston to seal the wellbore.

Preferably, the method includes providing a second linkage mechanism and a second moveable ram and actuating the second moveable ram in response to the axial movement of the piston in a substantially orthogonal direction to the axis of the throughbore opposite to the direction of the first ram.

Preferably, the at least one ram includes a cutting surface.

A cutting surface will allow ram to cut through the workover string, which is more efficient than crushing, and also allows subsequent disengagement of the workover string.

According to a third aspect of the present invention there is provided a control device for sealing a throughbore, the device having a generally cylindrical housing, the housing having a throughbore with a central axis, the housing including:

at least one moveable ram, at least one moveable piston, at least one linkage mechanism, the linkage mechanism being arranged so that in response to movement of the at least one piston parallel to the axis of the throughbore towards the at least one ram, the linkage mechanism forces the at least one ram to move substantially orthogonally to the axis of the throughbore across the throughbore.

By virtue of the present invention a wellbore incorporating a workover string can be sealed by a control device, which is compact and simple to operate.

BRIEF DESCRIPTION OF THE DRAWINGS

The present invention will now be described, by way of example, with reference to the accompanying diagrams in which.

DESCRIPTION OF EXAMPLE EMBODIMENTS

Figure 1:
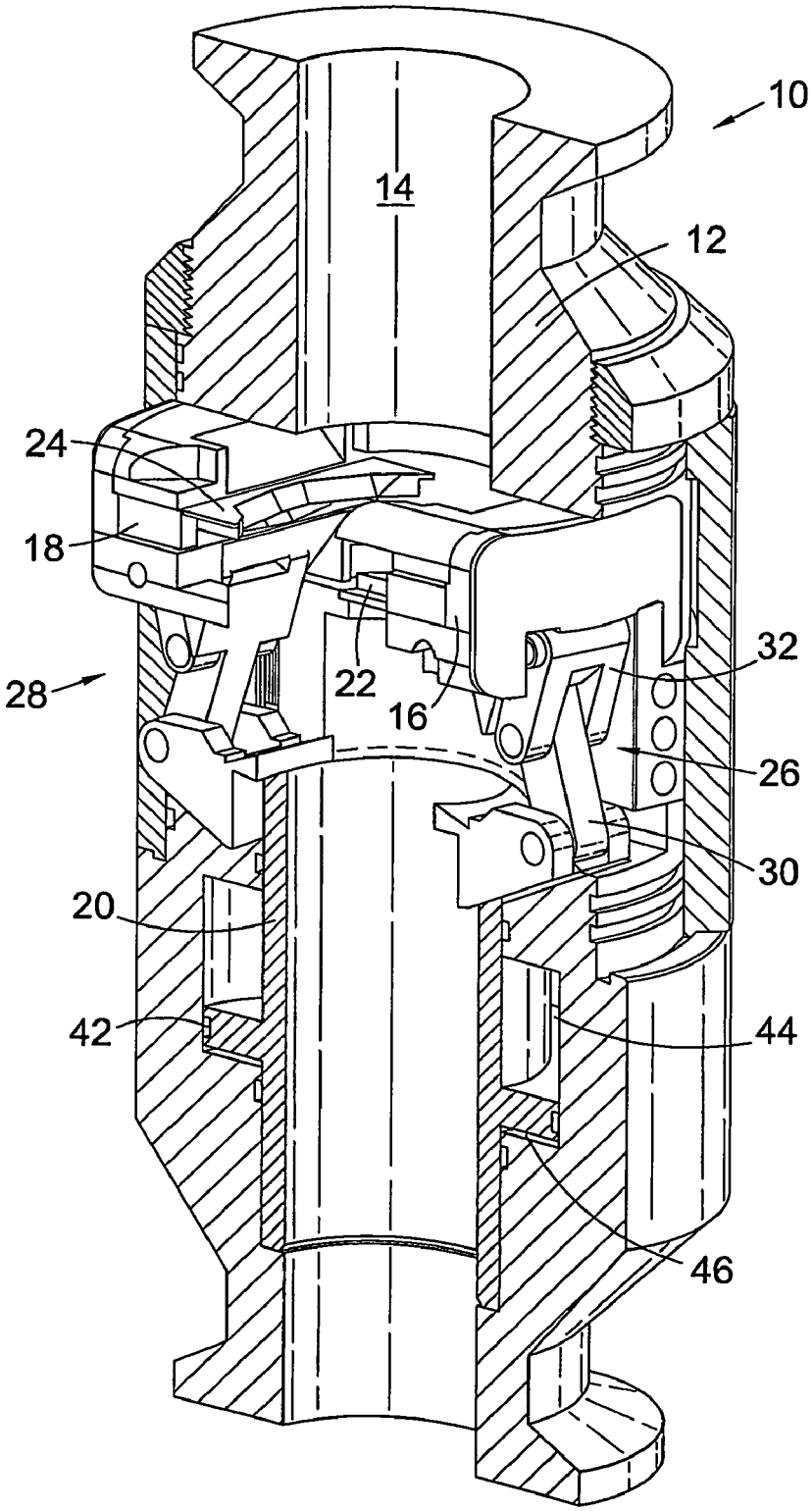
FIG. 1 is a cut away perspective view of a riser control device in an open configuration in accordance with a preferred embodiment of the present invention.
Figure 2:
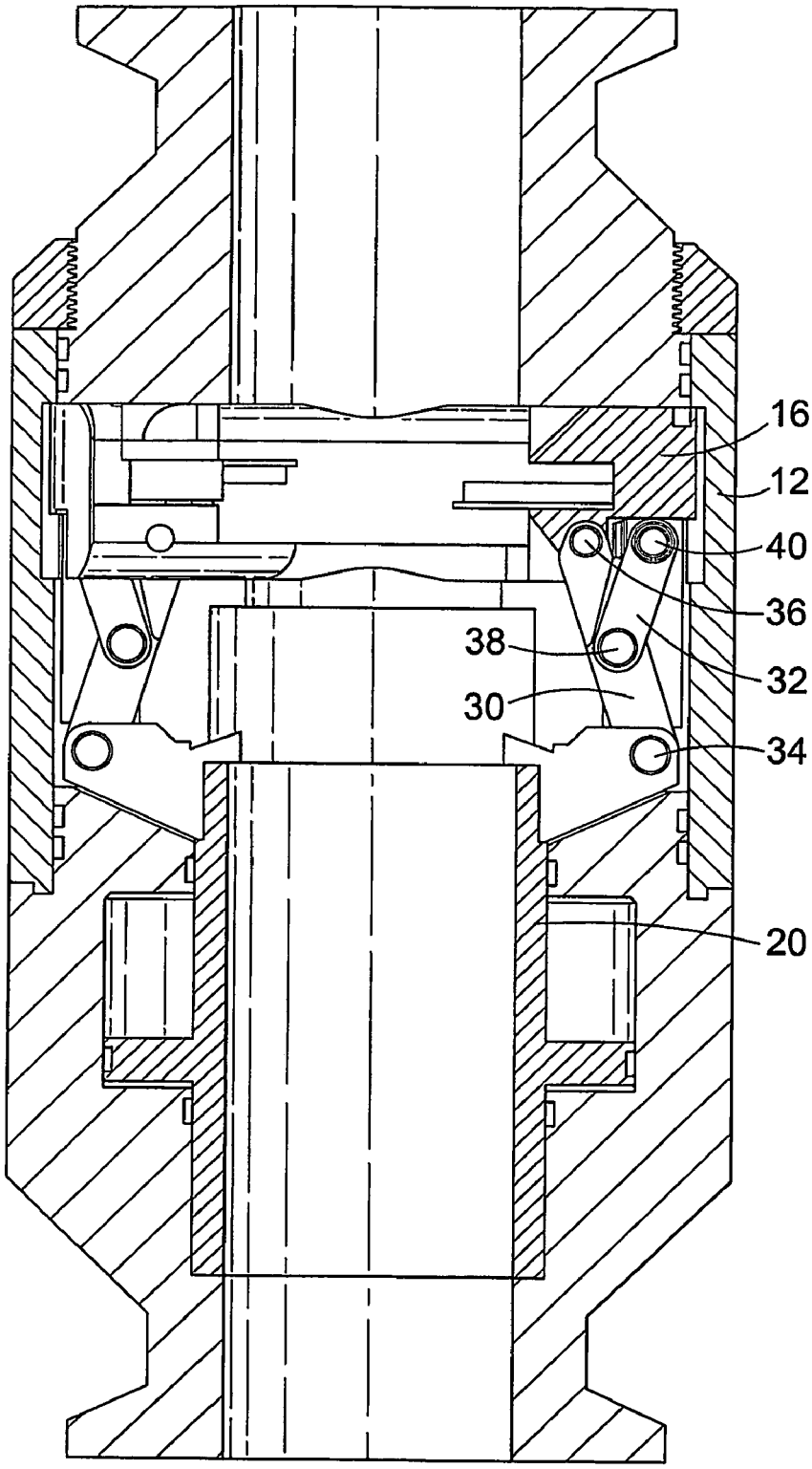
FIG. 2 is a cut away side view of the riser control device of FIG. 1 in an open configuration.

Reference is first made to FIGS. 1 and 2, which respectively depict a cut-away perspective view, and a cut away side view of a riser control device, generally indicated by reference numeral 10, in an open configuration in accordance with a preferred embodiment of the present invention. The riser control device includes a housing 12 having a throughbore 14. The external diameter of the housing 12 is sized such that the riser control device 10 can be located within a wellbore, for example an 18.5" internal diameter wellbore. The throughbore 14 has a diameter sufficient to allow the passage of a workover string (not shown) therethrough.

Within the housing 12 there is a first radially moveable ram 16, a second radially moveable ram 18 and an axially moveable annular piston 20. Mounted on the rams 16, 18 are respective cutting surfaces 22, 24, for, in use, cutting through a workover string (not shown). Connecting the piston 20 to the rams 16, 18 is a pair of linkage mechanisms 26, 28.

The first linkage mechanism 26, best viewed with reference to FIG. 2, comprises a first linkage member 30 and a second linkage member 32. The first linkage member 30 is pivotally mounted at a first pin joint 34 to the annular piston 20, and pivotally mounted at a second pin joint 36 to the first ram 16. The second linkage member 32 is pivotally mounted at a third pin joint 38 to the first linkage member 30 and pivotally mounted at a fourth pin joint 40 to the housing 12. The fourth pin joint 40 is axially displaced from the first pin join 34, and radially displaced form the second pin joint 36. Only the first linkage mechanism 26 is described as the second linkage mechanism 28 is a mirror image of the first linkage mechanism 26.

Figure 3:
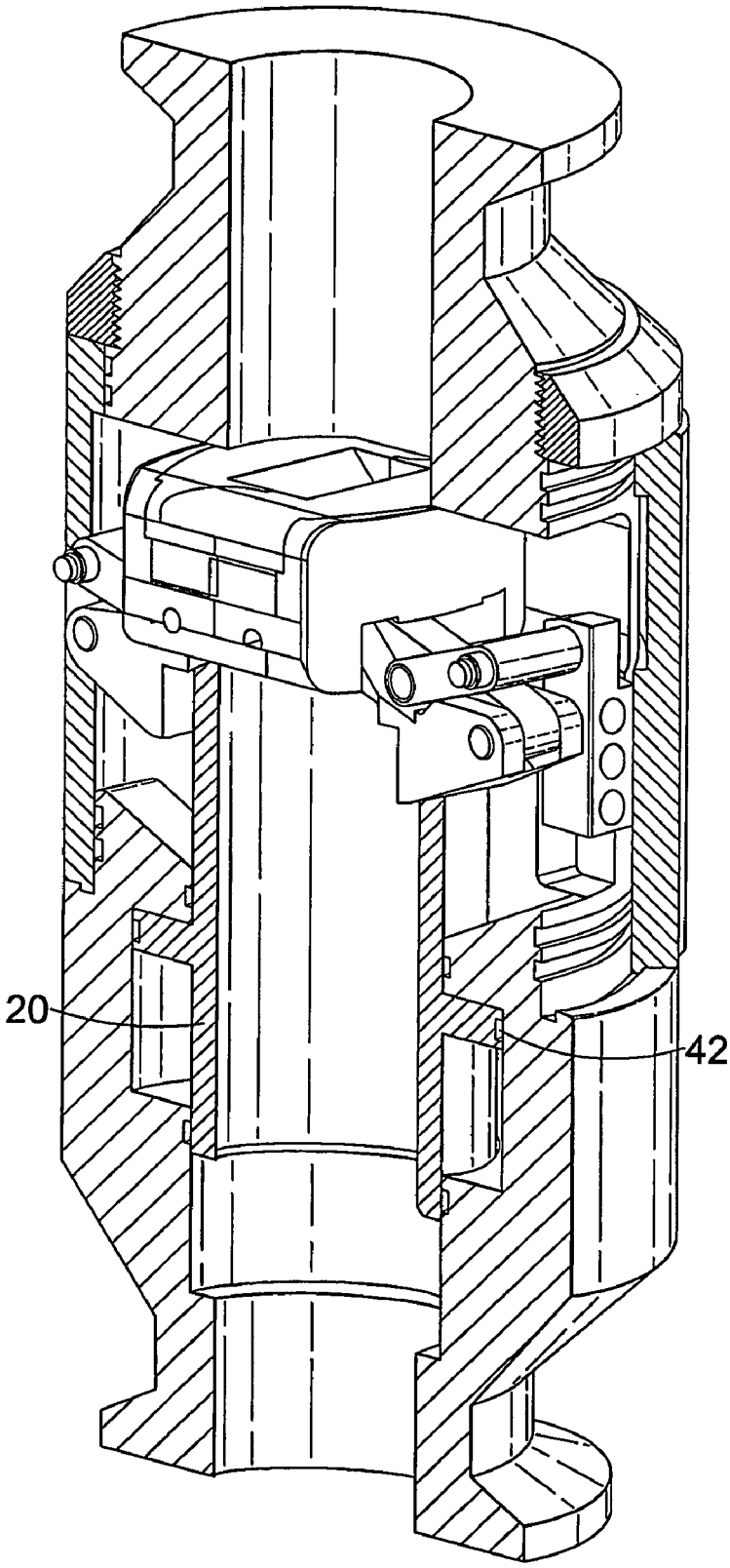
FIG. 3 is a cut away perspective view of the riser control device of FIGS. 1 and 2 in a closed configuration.

The annular piston 20 is operated hydraulically. Hydraulic pressure is used to move the annular piston 20 from the position shown in FIGS. 1 and 2 to the position shown in FIG. 3. The piston 20 includes a seal 42 which together with the annular piston 20 and the housing 12 define an upper annular chamber 44 and a lower annular chamber 46. To move the annular piston 20, hydraulic fluid (not shown) is bled out of the upper piston chamber 44 through a port (not shown) and hydraulic fluid is pumped into the lower piston chamber 46 through a port (not shown). Under the action of the hydraulic fluid being pumped into the lower annular chamber 46, the piston 20 will move axially towards the rams 16, 18. The upward movement of the piston 20 actuates the mechanisms 26, 28 closing the cutting rams 16, 18 which, in turn, forces the cutting surfaces 22, 23 to cut through the riser (not shown). The rams 16, 18 come together to seal the throughbore 14, as shown in FIG. 3.

Figure 4:
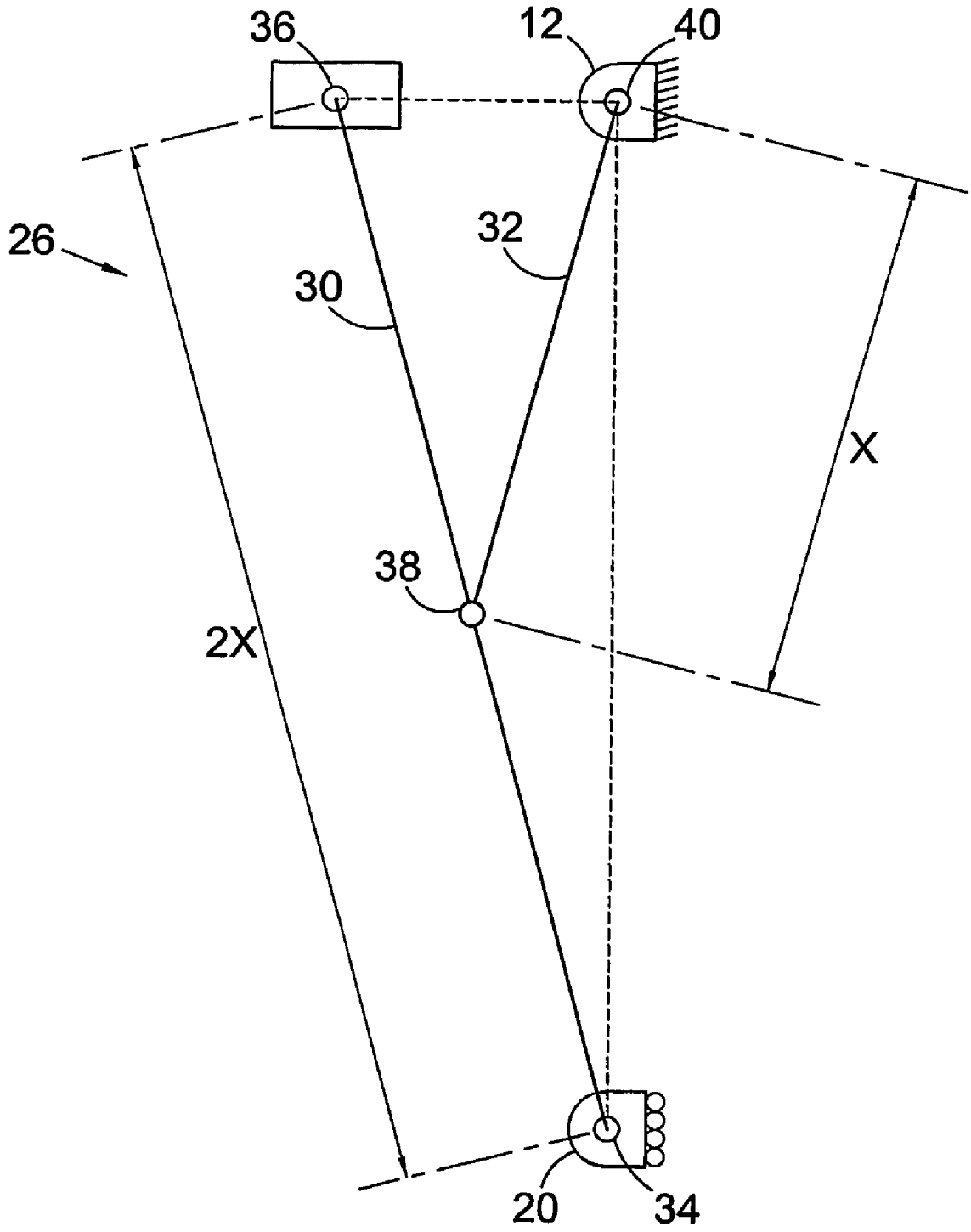
FIG. 4 is a schematic view of the linkage mechanism of the riser control device of FIGS. 1 to 3.

Reference is now made to FIG. 4, which is a schematic side view of the first linkage mechanism 26. The first linkage member 30 is twice as long (length 2×) as the second linkage member 32 (length). It can also be seen that pin joints 34, 36 and 40 define a right-angle triangle and that pin joint 38 is located at the mid-point of the first linkage member 30. Linkage mechanism 28 (not shown in detail) is identical to mechanism 26 and the description of the operation of mechanism 26 applies to mechanism 28.

Referring now to FIGS. 5*a*-5*e*, there are shown schematic views of the operation of the linkage 26 of FIG. 4.

Figure 5A:
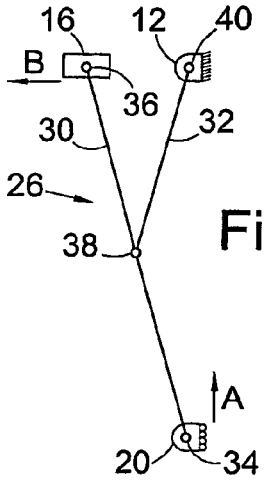
FIGS. 5*a* to 5*e* are schematic views showing the sequence of movements during the operation of the linkage of FIG. 4.

Firstly referring to FIG. 5*a*, the linkage is shown in the start position, i.e. the rams 16, 18 are fully retracted into the housing 12 (as shown in FIGS. 1 and 2).

Figure 5B:
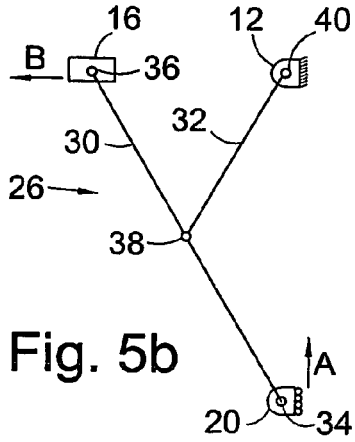

In FIG. 5*b* the piston 20 has started to move axially upwards, in the direction of arrow A, towards the fourth pin joint 40 where the second linkage member 32 is pivotally secured to the housing 12. As the piston 20 moves axially upwards, the ram 16 moves radially into the bore 14 (not shown) as indicated by arrow B. In this early stage of the cycle, the relative movements of the piston 20 and the ram 16 are non-linear; a large movement of the ram 16 occurs in response to a small movement of the piston 20.

Figure 5C:
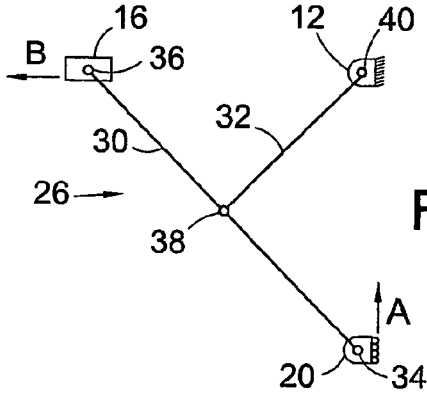

Referring now to FIG. 5*c*, this figure represents the mid-point of the movement of the linkage mechanism 26 and is the only point in the cycle where the relationship between the movement of the piston 20 and the movement of the ram 16 is linear.

Figure 5D:
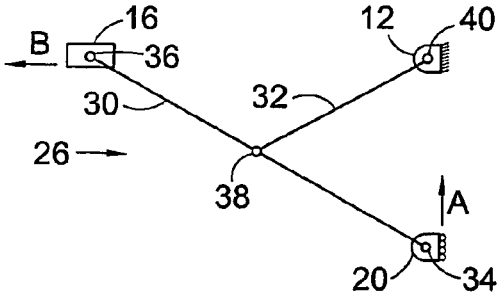

Referring now to FIG. 5*d*, as the piston approaches the limit of its travel, the relationship between the movement of the piston 20 and the ram 16 is the reverse of that shown in FIG. 5*b*, i.e. a large movement of the piston 20 results in a small movement of ram 16.

Figure 5E:
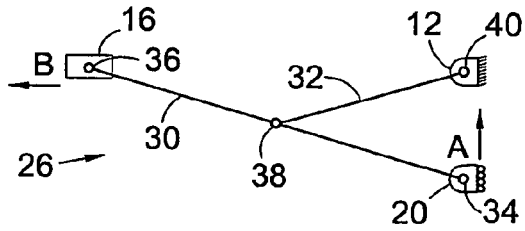

Referring now to FIG. 5*e*, the mechanism 26 has reached the full extent of its travel as will mechanism 28 and, as shown in FIG. 3, the rams 16, 18 are fully extended into the bore and the first ram 16, together with the second ram 18, have sealed the bore 14.

Various modifications and improvements may be made to the embodiments hereinbefore described without departing from the scope of the invention. For example, it will be understood that a single linkage mechanism and ram may be used to shear through a workover string and seal the bore but two mechanisms and opposed rams, as described above, are preferred for cutting efficiency.

Those of skill in the art will also recognise that the above-described embodiment of the invention provides a device 10 whereupon actuation of the piston 20 will shear through a workover string and seal the bore 14. The device 10 is dimensioned such that it will fit inside a wellbore allowing a workover string within the wellbore to be sealed.

The invention claimed is:

1. A control device for sealing a wellbore, the device having a generally cylindrical housing, the housing having a cylindrical throughbore with a central axis for receiving a workover string, the housing including:

at least one moveable ram, at least one moveable piston, at least one linkage mechanism comprising a first linkage member and a second linkage member, the first linkage member having a first end and a second end, the first end being pivotally coupled to the at least one piston and the second end being pivotally coupled to the at least one ram, the pivotal coupling is achieved by using pin joints, the second linkage member having a first end and a second end, the first end being pivotally coupled to the first linkage member and the second end being pivotally coupled to the housing and being permanently fixed axially relative to the housing, the linkage mechanism being arranged so that in response to movement of the at least one piston parallel to the axis of the throughbore towards the at least one ram, the linkage mechanism forces the at least one ram to move substantially orthogonally to the axis of the throughbore across the throughbore, and wherein the second end of the second linkage member is coupled to the housing by a second linkage-second end pin joint, the second linkage-second end pin joint and the first linkage-first end pin joint being located on an axis parallel to the axis of the throughbore, and the second linkage-second end pin joint and the first linkage-second end pin joint being located on an axis located substantially orthogonal to the axis of the throughbore.

2. A device as claimed in claim 1 wherein the first end of the second linkage member is pivotally coupled to the midpoint of the first linkage member.

3. A device as claimed in claim 1 wherein the length of the first linkage member is twice the length of the second linkage member.

4. A device as claimed in claim 1 wherein the at least one ram includes a cutting surface.

5. A device as claimed in claim 4 wherein the cutting surface is designed to cut coiled tubing.

6. A device as claimed in claim 1 wherein there are two opposing rams and two linkage mechanisms.

7. A device as claimed in claim 1 wherein there is one annular piston.

8. A method of sealing a wellbore, the method comprising:

disposing a generally cylindrical housing in a well string, the housing having a throughbore with a central axis for receiving a workover string;

actuating at least one moveable piston in a direction parallel to the axis of the throughbore, coupling the piston by a linkage mechanism to at least one moveable ram, the at least one ram including a cutting surface, the linkage mechanism comprising a first linkage member and a second linkage member, the first linkage member having a first end and a second end, the first end being pivotally coupled to the at least one piston and the second end being pivotally coupled to the at least one ram, the second linkage member having a first end and a second end, the first end being pivotally coupled to the first linkage member and the second end being pivotally coupled to the housing and being permanently fixed axially relative to the housing, and causing the ram to move substantially orthogonally to the axis of the throughbore across the throughbore in response to the axial movement of the piston to seal the wellbore.

9. A method as claimed in claim 8 wherein the method includes providing a second linkage mechanism and a second moveable ram and actuating the second moveable ram in response to the axial movement of the piston in a substantially orthogonal direction to the axis of the throughbore opposite to the direction of the first ram.

* * * * *